US006015255A

United States Patent [19]

Vander Meer

[11] Patent Number: 6,015,255

[45] Date of Patent: Jan. 18, 2000

[54] SELF LOCKING FORKLIFT ATTACHMENT

[76] Inventor: Brett Vander Meer, 10757 Meadow La., Palos Hills, Ill. 60456

[21] Appl. No.: 09/146,714

[22] Filed: Sep. 3, 1998

[51] Int. Cl.[7] ..... B66F 9/18

[52] U.S. Cl. ..... 414/607; 187/237; 414/785

[58] Field of Search ..... 414/607, 785, 414/787; 187/237

[56] References Cited

U.S. PATENT DOCUMENTS

| | | | |
|---|---|---|---|
| 2,582,663 | 1/1952 | Weiss | 214/66 |
| 3,392,858 | 7/1968 | Fernstrom et al. | 414/785 |
| 3,438,669 | 4/1969 | Vik | 294/90 |
| 3,971,485 | 7/1976 | Hoppey | 214/313 |
| 4,318,661 | 3/1982 | Helm | 414/607 |
| 5,281,076 | 1/1994 | Lehman | 414/607 |
| 5,306,110 | 4/1994 | Cline | 414/607 |
| 5,316,433 | 5/1994 | Chase | 414/607 |

FOREIGN PATENT DOCUMENTS

| | | | |
|---|---|---|---|
| 92/00001 | of 0000 | Australia | B66F 9/18 |
| 93/00135 | of 0000 | European Pat. Off. | B66F 9/18 |
| 0263909 | 4/1988 | European Pat. Off. | 414/607 |
| 0225122 | 7/1985 | Germany | 414/607 |
| 1068382 | 1/1994 | U.S.S.R. | 414/607 |
| 2137161 | 10/1994 | United Kingdom | 414/607 |

*Primary Examiner*—David A. Bucci
*Assistant Examiner*—Isobel A. Parker
*Attorney, Agent, or Firm*—Rudnick & Wolfe

[57] ABSTRACT

The present invention is a forklift attachment device which automatically secures to the tongs of a forklift when the tongs are raised. The present invention functions to prevent a forklift load from becoming dislodged prematurely. The operative portion of the present invention is a pair of elastomer locking brakes which are positioned along the tongs of the forklift. The forks are inserted into the device. As the load is moved upwardly, levers attached to the locking brakes fall downwardly causing the locking brakes to move into operative engagement with the forks. When the load is returned to a position on the floor, the levers are returned to the starting position causing the locking brakes to release the attachment from the forks.

9 Claims, 2 Drawing Sheets

SELF LOCKING FORKLIFT ATTACHMENT

BACKGROUND OF THE INVENTION

1. Field of the Invention

The present invention relates to movement of materials. More particularly, the present invention relates to attachments for a forklift.

2. Description of the Prior Art

Forklifts are a common machine used to move heavy loads within a warehouse. To maintain efficiency the loads must be moved quickly, which necessitates the operators driving the forklifts at a high rate of speed. Often when the forklift is stopped the attachment tends to slide on the forks. A dangerous situation develops when the load slides far enough to cause the load to fall or upset the forklift. Locking devices can be used to secure the load to the fork, but if operator intervention is required, efficiency may decrease. Accordingly there is a need in the art for a device which removably secures and releases a load to the forks without operator intervention.

Numerous innovations for forklift attachments have been provided in the prior art and are described as follows. Even though these innovations may be suitable for the specific individual purposes that they address, they differ from the present invention as hereinafter contrasted.

In U.S. Pat. No. 5,281,076, titled Forklift Attachment, invented by Marcus S. Legman, an attachment is provided for a forklift. The attachment includes a frame having a mechanism for attaching said frame to the forks of a forklift. A carriage assembly is provided including a carriage frame and drum engaging member. The carriage frame is connected to the main frame for pivotable movement about a horizontal axis of rotation. The drum engaging member is connected to the carriage frame for rotational movement about the axis of rotation. The drum engaging member includes first and second clamps mounted on the drum engaging member for movement relative to one another between open and closed positions.

In U.S. Pat. No. 4,318,661, titled Drum Handling Device for Forklift, invented by J. Thomas Helm, a drum handling attachment for a forklift truck is described which includes a frame for attachment to the forks of the forklift truck. The frame supports a transverse rotary shaft upon which are mounted for rotary movement therewith, at least a pair of gripping arms, at least one of the gripping arms being transversely adjustable on the shaft for handling one or more drums of different sizes.

In U.S. Pat. No. 3,971,485, titled Forklift Attachment, invented by Thomas Hopped, an attachment for a conventional forklift is described for enabling the lifting and pivoting of elongated containers such as barrels. The patented invention includes; a base frame means having connection means for connection to the forks of a forklift, a first and second spaced pivotal hydraulically operated container clamp jaw members on the frame, and hydraulic tilt means for pivoting the container clamp jaws to enable pouring from a container.

In U.S. Pat. No. 3,438,669, titled Clamp Mechanism for a Lifting Implement, invented by Alba M. Vi, a mechanical clamp apparatus is described for a lifting implement composed of a frame work to which a pair of horizontal parallel arms are pivotally secured at their rearward ends. A jaw is mounted on the forward end of each arm and is pivotally connected at its free end to the framework to confine the movement of the arms and jaws to an arcuate path extending centrally then downwardly so that the downward pressure of an object on the jaws causes the jaws to move toward one another against the object with a pressure greatly exceeding the weight of the object.

In U.S. Pat. No. 2,582,663, titled Industrial Truck Attachment, invented by Samuel Weirs, an industrial truck is described which is adapted to handle drums and barrels having rings around the circumference of the cylinder. The device is fitted to the front hoisting system. A pair of lifting tangs are positioned perpendicular to the front hoisting system and are manually adjusted to adapt to the smaller diameter of a barrel or drum. As the front hoisting system lifts the lifting tangs, they engage the rings and move the drum upwardly. Once the proper distance between the tangs is established no further intervention is required by the operator.

In Patent number PCT/EP93/00135, titled Attachment for a Forklift, a device is attached to a forklift truck and functions to facilitate moving of slab shaped components. The slab shaped components can be rotated 180 degrees. The patented invention lacks feature similar to the present invention.

In Patent number PCT/AU92/00001, titled Barrel Handling Device, a device to carry a group of beer kegs is described which has a frame attachable to a pantograph of a forklift truck.

The above patented inventions differ from the present invention because they fail to describe or claim at least one combination of the following features depicted in the present invention; a self locking mechanism which secures an attachment to a tong of a forklift when the load is lifted, a release mechanism which when the load is lowered onto a support releases the locking mechanism from the fork.

Numerous innovations for forklift attachments have been provided in the prior art that are adapted to be used. Even though these innovations may be suitable for the specific individual purposes that they address, they would not be suitable for the purposes of the present invention as heretofore described.

SUMMARY OF THE INVENTION

The present invention is a forklift attachment device which when in contact with the tongs of a forklift automatically secures to the tongs. The present invention functions to prevent a forklift load from becoming dislodged prematurely. The operative portion of the present invention is a pair of elastomer cams which are positioned over openings of the attachment. The tongs are inserted into the device. As the load is moved upwardly, levers attached to the cams fall downwardly causing the cams to move into operative engagement with the forks. When the load is returned to a position on the floor, the levers are returned to the starting position and cause the cams to release the attachment from the forks.

The types of problems encountered in the prior art are that attachments and therefore loads supported by forklifts can slip off the ends of the forks.

In the prior art, unsuccessful attempts to solve this problem were attempted. Specifically complex devices which required manual intervention or are complex and costly to install on each attachment or fork have been tried. However, the problem is solved by the present invention because a simple lever and cam attach the attachment to the tongs The present invention is actuated by gravity when the load is lifted from a support.

The present invention is contrary to the teaching of the art which teaches complex devices requiring manual intervention and complex devices which are not automatic.

The present invention solves a long felt need for a simple automatic device which secures an attachment to the tongs of a forklift.

Accordingly, it is an object of the present invention to provide a locking device which prevents an attachment from slipping off of a forklift tong.

More particularly, it is an object of the present invention to provide automatic locking features which are responsive to the attachment being raised from a support.

In keeping with these objects, and with others which will become apparent hereinafter, one feature of the present invention resides, briefly stated, in a cam positioned on a fork in operational proximity to the receptor for an attachment.

When the self locking forklift attachment is designed in accordance with the present invention, attachments are prevented from slipping off the tines of a forklift.

In accordance with another feature of the present invention, a lever is attached at one end to the cam and at the opposite end is in contact with the floor, which when the load is raised, falls downwardly causing the cam to rotate into engagement with the tine.

Another feature of the present invention is that when the attachment is lowered onto a support, the lever is caused to rotate the cam into disengagement with the tongs.

Yet another feature of the present invention is that the cam rotates about a pivot.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

DESCRIPTION OF THE PREFERRED EMBODIMENT

Figure 1:
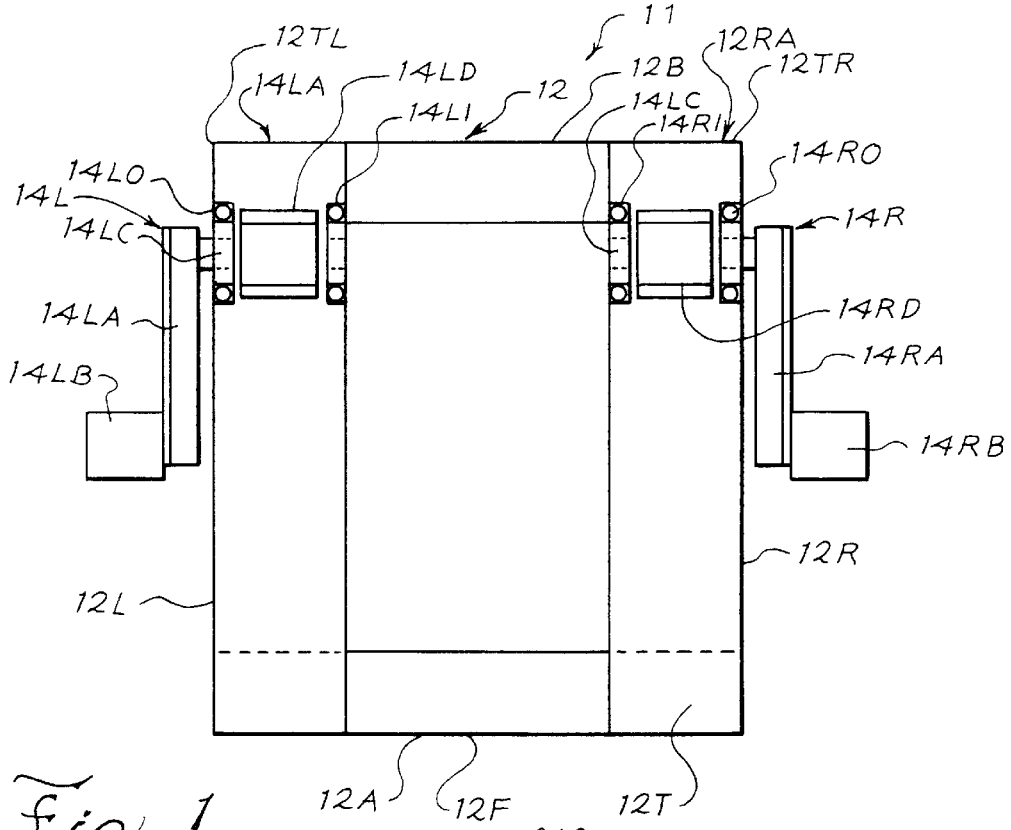
FIG. 1 is a top view of a first self locking forklift attachment (110).
Figure 4:
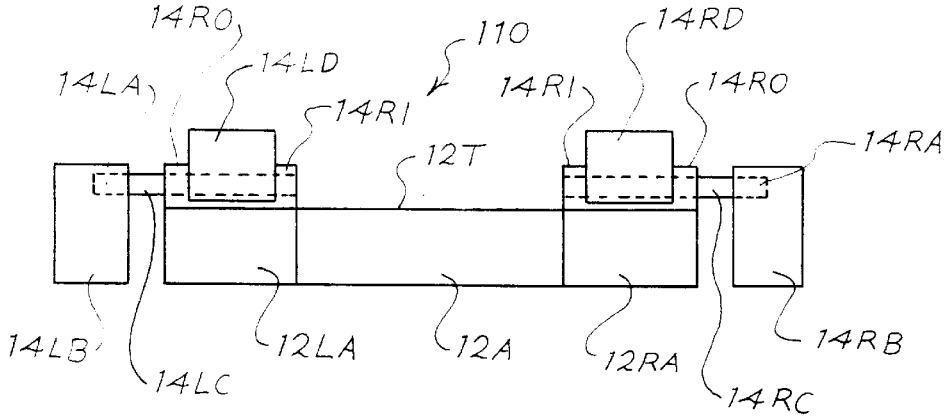
FIG. 4 is a front view of a first self locking forklift attachment (110).

Firstly, referring to FIG. 1 and FIG. 4 which are a top view and front of a first self locking forklift attachment (110), respectively. The first self locking forklift attachment (110) comprises an attachment (12) which comprises an attachment front (12F), an attachment left side (12L) having an attachment left side forklift slot (12LA) therein, an attachment right side (12R) having an attachment right side forklift slot (12RA) therein, an attachment back (12B), an attachment bottom (12A), and an attachment top (12T) having an attachment top left opening (12TL) and an attachment top right opening (12TR). The attachment left side forklift slot (12LA) and the attachment right side forklift slot (12RA) have openings at the attachment back (12B) wherein a forklift left tongs (16L) and forklift right tong (16R) are inserted, respectively.

The first self locking forklift attachment (110) further comprises a left locking arm (14LA) comprises a left locking weight (14LB) securely mounted at an outer distal end. The left locking arm (14LA) is securely attached at an inner distal end to a left distal end of a left locking shaft (14LC) which is rotatably mounted within a left locking inner bracket (14LI) and a left locking outer bracket (14LO). A left locking brake (14LD) is securely mounted on the left locking shaft (14LC) between the left locking inner bracket (14LI) and the left locking outer bracket (14LO) over the attachment top left opening (12TL).

The first self locking forklift attachment (110) further comprises a right locking arm (14RA) comprises a right locking weight (14RB) securely mounted at an outer distal end. The right locking arm (14RA) is securely attached at an inner distal end to a right distal end of a right locking shaft (14RC) which is rotatably mounted within a right locking inner bracket (14RI) and a right locking outer bracket (14RO). A right locking brake (14RD) is securely mounted on the right locking shaft (14RC) between the right locking inner bracket (14RI) and the right locking outer bracket (14RO) over the attachment top right opening (12TR). The attachment (12) is manufactured from a material selected from a group consisting of metal, metal alloy, wood, wood composite, plastic and plastic composite. The right locking weight (14RB) may be rotationally attached mounted at an outer distal end of the right locking arm (14RA). The left locking weight (14LB) may be rotationally attached mounted at an outer distal end of the left locking arm (14LA).

The attachment 12 is manufactured from a material selected from a group consisting of metal, metal alloy, wood, wood composite, plastic and plastic composite. The left locking brake (14LD) and the right locking brake (14RD) are manufactured from a material selected from a group consisting of metal, metal alloy, wood, wood composite, plastic, plastic composite, rubber and rubber composite.

Figure 3A:
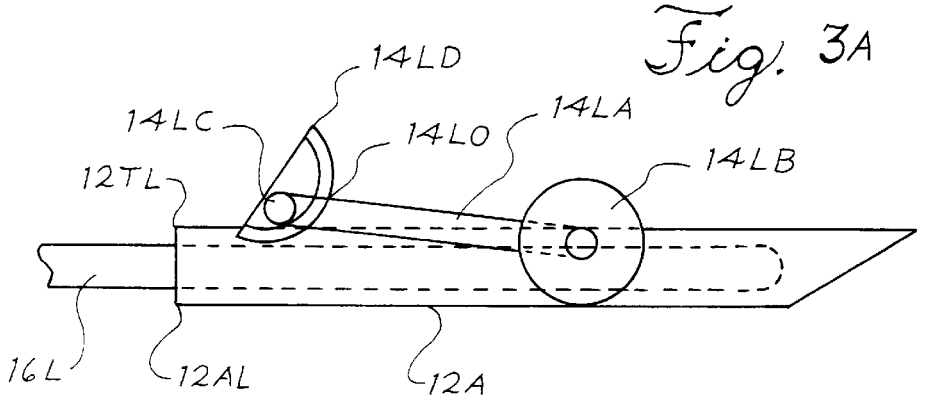
FIG. 3A is a left side view of a first self locking forklift attachment (10) exhibiting the left locking arm (14LA) and left locking weight (14LB) in a horizontal unlocked position.
Figure 3B:
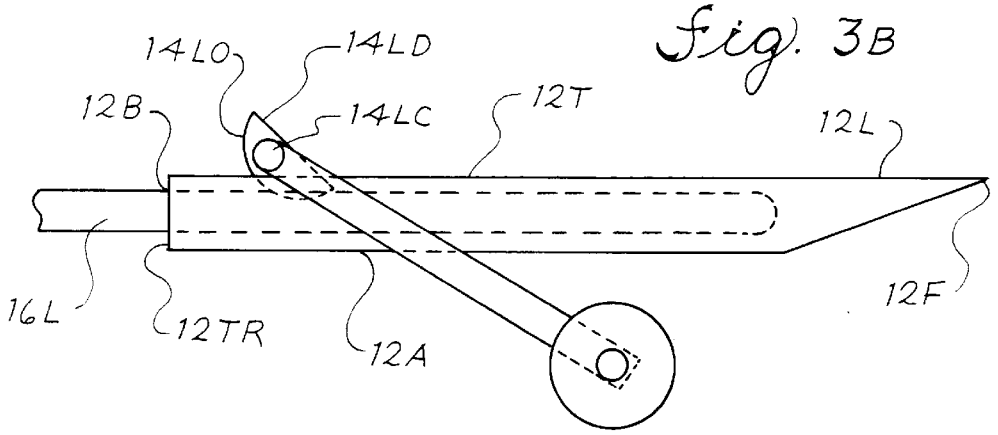
FIG. 3B is a left side view of a first self locking forklift attachment (10) exhibiting the left locking arm (14LA) and left locking weight (14LB) in an angled locked position.

Now referring to FIG. 3A and FIG. 3B which are a left side view of a first self locking forklift attachment (10) exhibiting the left locking arm (14LA) and left locking weight (14LB) in a horizontal unlocked and locked position, respectively.

When a user inserts the forklift left tong (16L) into the attachment left side forklift slot (12LA) and inserts the forklift right tong (16R) into the attachment right side forklift slot (12RA) and lifts, the left locking weight (14LB) drops down rotating the left locking arm (14LA) engaging the left locking brake (14LD) against the forklift left tong (16L) and concurrently, the right locking weight (14RB) drops down rotating the right locking arm (14RA) engaging the right locking brake (14RD) against the forklift right tong (16R).

Figure 2:
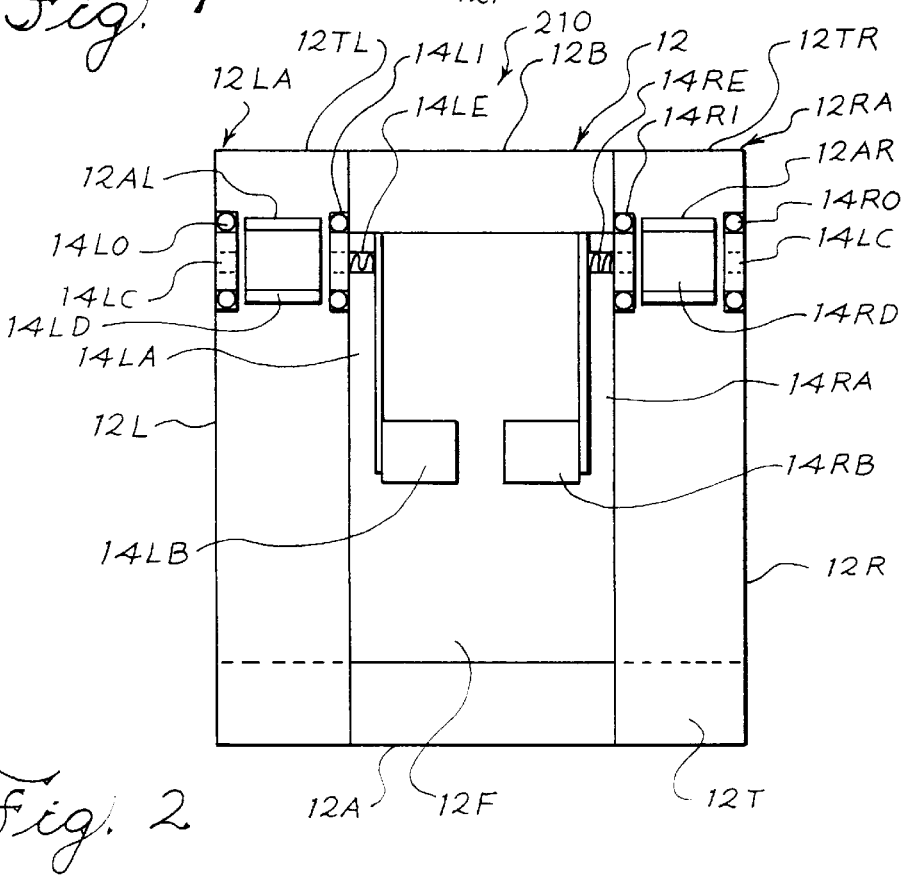
FIG. 2 is a top view of a second self locking forklift attachment (210).

Lastly, referring to FIG. 2 which is a top view of a second self locking forklift attachment (210) which comprises an attachment (12) which comprises an attachment front (12F), an attachment left side (12L) having an attachment left side forklift slot (12LA) therein, an attachment right side (12R) having an attachment right side forklift slot (12RA) therein, an attachment back (12B), an attachment bottom (12A) having an attachment bottom left opening (12AL) and an attachment bottom right opening (12AR), and an attachment top (12T). The attachment left side forklift slot (12LA) and the attachment right side forklift slot (12RA) have openings at the attachment back (12B) wherein a forklift left tong (16L) and forklift right tong (16R) are inserted, respectively.

The second self locking forklift attachment (210) further comprises a left locking arm (14LA) which comprises a left locking weight (14LB) securely mounted at an inner distal end. The left locking arm (14LA) is securely attached at an inner distal end to a right distal end of a left locking shaft (14LC) which is rotatably mounted within a left locking inner bracket (14LI) and a left locking outer bracket (14LO) which are securely mounted on the attachment bottom (12A). A left locking brake (14LD) is securely mounted on the left locking shaft (14LC) between the left locking inner bracket (14LI) and the left locking outer bracket (14LO) over the attachment bottom left opening (12AL).

The second self locking forklift attachment (210) further comprises a right locking arm (14RA) comprises a right locking weight (14RB) securely mounted at an inner distal end. The right locking arm (14RA) is securely attached at an inner distal end to a left distal end of a right locking shaft (14RC) which is rotatably mounted within a right locking inner bracket (14RI) and a right locking outer bracket (14RO) which are securely mounted on the attachment bottom (12A). A right locking brake (14RD) is securely mounted on the right locking shaft (14RC) between the right locking inner bracket (14RI) and the right locking outer bracket (14RO) over the attachment bottom right opening (12AR). When a user inserts the forklift left tong (16L) into the attachment left side forklift slot (12LA) and inserts the forklift right tong (16R) into the attachment right side forklift slot (12RA) and lifts, the left locking weight (14LB) drops down rotating the left locking arm (14LA) engaging the left locking brake (14LD) against the forklift left tong (16L) and concurrently, the right locking weight (14RB) drops down rotating the right locking arm (14RA) engaging the right locking brake (14RD) against the forklift right tong (16R).

The attachment (12) is manufactured from a material selected from a group consisting of metal, metal alloy, wood, wood composite, plastic and plastic composite.

The left locking brake (14LD) and the right locking brake (14RD) are manufactured from a material selected from a group consisting of metal, metal alloy, wood, wood composite, plastic, plastic composite, rubber and rubber composite.

The second self locking forklift attachment (210) wherein a left locking spring (14LE) is mounted on the left locking shaft (14LC) between the left locking inner bracket (14LI) and the left locking arm (14LA), a right locking spring (14RE) is mounted on the right locking shaft (14RC) between the right locking inner bracket (14RI) and the right locking arm (14RA). Left locking spring (14LE) is biased against the left locking inner bracket (14LI) and the left locking arm (14LA), while right locking spring (14RE) is similarly biased against right locking inner bracket (14RI) and right locking arm (14RA). The locking springs (14LE) and 14(RE) enhance the stability of the respective locking arms (14LA) and (14RA) when the locking arms (14LA) and (14RA) move downwardly.

It will be understood that each of the elements described above, or two or more together, may also find a useful application in other types of constructions differing from the type described above.

While the invention has been illustrated and described as embodied in a self locking forklift attachment, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A first self locking forklift attachment (110) comprising:

A) an attachment (12) which comprises an attachment front (12F), an attachment left side (12L) having an attachment left side forklift slot (12LA) therein, an attachment right side (12R) having an attachment right side forklift slot (12RA) therein, an attachment back (12B), an attachment bottom (12A), and an attachment top (12T) having an attachment top left opening (12TL) and an attachment top right opening (12TR), the attachment left side forklift slot (12LA) and the attachment right side forklift slot (12RA) having openings at the attachment bottom (12B) wherein a forklift left tong (16L) and forklift right tong (16R) are inserted, respectively;

B) a left locking arm (14LA) comprises a left locking weight (14LB) securely mounted at an outer distal end, the left locking arm (14LA) is securely attached at an inner distal end to a left distal end of a left locking shaft (14LC) which is rotatably mounted within a left locking inner bracket (14LI) and a left locking outer bracket (14LO), a left locking brake (14LD) is securely mounted on the left locking shaft (14LC) between the left locking inner bracket (14LI) and the left locking outer bracket (14LO) over the attachment top left opening (12TL); and C) a right locking arm (14RA) comprises a right locking weight (14RB) securely mounted at an outer distal end, the right locking arm (14RA) is securely attached at an inner distal end to a right distal end of a right locking shaft (14RC) which is rotatably mounted within a right locking inner bracket (14RI) and a right locking outer bracket (14RO), a right locking brake (14RD) is securely mounted on the right locking shaft (14RC) between the right locking inner bracket (14RI) and the right locking outer bracket (14RO) over the attachment top right opening (12TR), when a user inserts the forklift left tong (16L) into the attachment left side forklift slot (12LA) and inserts the forklift right tong (16R) into the attachment right side forklift slot (12RA) and lifts, the left locking weight (14LB) drops down rotating the left locking arm (14LA) engaging the left locking brake (14LD) against the forklift left tong (16L) and concurrently, the right locking weight (14RB) drops down rotating the right locking arm (14RA) engaging the right locking brake (14RD) against the forklift tong (16R).

2. The first self locking forklift attachment (110) as described in claim 1, wherein the attachment (12) is manufactured from a material selected from a group consisting of metal, metal alloy, wood, wood composite, plastic and plastic composite.

3. The first self locking forklift attachment (110) as described in claim 1, wherein the left locking brake (14LD) and the right locking brake (14RD) are manufactured from a material selected from a group consisting of metal, metal alloy, wood, wood composite, plastic, plastic composite, rubber and rubber composite.

4. The first self locking forklift attachment (110) as described in claim 1, wherein the right locking weight (14RB) is rotatably attached at an outer distal end of the right locking arm (14RA).

5. The first self locking forklift attachment (110) as described in claim 1, wherein the left locking weight (14LB) is rotatably attached at an outer distal end of the left locking arm (14LA).

6. A second self locking forklift attachment (210) comprising:

A) an attachment (12) which comprises an attachment front (12F), an attachment left side (12L) having an attachment left side forklift slot (12LA) therein, an attachment right side (12R) having an attachment right side forklift slot (12RA) therein, an attachment back (12B), an attachment bottom (12A) having an attachment bottom left opening (12AL) and an attachment bottom right opening (12AR), and an attachment top (12T), the attachment left side forklift slot (12LA) and the attachment right side forklift slot (12RA) having openings at the attachment bottom (12B) wherein a forklift left tong (16L) and forklift right tong (16R) are inserted, respectively;

B) a left locking arm (14LA) comprises a left locking weight (14LB) securely mounted at an inner distal end, the left locking arm (14LA) is securely attached at an inner distal end to a right distal end of a left locking shaft (14LC) which is rotatably mounted within a left locking inner bracket (14LI) and a left locking outer bracket (14LO) which are securely mounted on the attachment bottom (12A), a left locking brake (14LD) is securely mounted on a left locking shaft (14LC) between the right locking inner bracket (14LI) and the left locking outer bracket (14LO) over the attachment bottom left opening (12AL); and C) a right locking arm (14RA) comprises a right locking weight (14RB) securely mounted at an inner distal end, the right locking arm (14RA) is securely attached at an inner distal end to a left distal end of a right locking shaft (14RC) which is rotatably mounted within a right locking inner bracket (14RI) and a right locking outer bracket (14RO) which are securely mounted on the attachment bottom (12RA), a right locking brake (14RD) is securely mounted on the right locking shaft (14RC) between the right locking inner bracket (14RI) and the right locking outer bracket (14RO) over the attachment bottom right opening (12AR), when a user inserts the forklift left tong (16L) into the attachment left side forklift slot (12LA) and inserts the forklift right tong (16R) into the attachment left side forklift slot (12LA) and inserts the forklift right tong (16R) into the attachment right side forklift slot (12RA) and lifts, the left locking weight (14LB) drops down rotating the left locking arm (14LA) engaging in the left locking brake (14LD) against the forklift left tong (16L) and concurrently, the right locking weight (14RB) drops down rotating the right locking arm (14RA) engaging the right locking brake (14RD) against the forklift right tong (16R).

7. The second self locking forklift attachment (210) as described in claim 6, wherein the attachment (12) is manufactured from a material selected from a group consisting of metal, metal alloy, wood, wood composite, plastic and plastic composite.

8. The second self locking forklift attachment (210) as described in claim 6, wherein the left locking brake (14LD) and the right locking brake (14RD) are manufactured from a material selected from a group consisting of metal, metal alloy, wood, wood composite, plastic, plastic composite, rubber and rubber composite.

9. The second self locking forklift attachment (210) as described in claim 6, wherein a left locking spring (14LE) is mounted on the left locking shaft (14LC) between the left locking inner bracket (14LI) and the left locking arm (14LA), a right locking spring (14RE) is mounted on the right locking shaft (14RC) between the right locking inner bracket (14RI) and the right locking arm (14RA).

* * * * *